US010290924B2

(12) United States Patent
Chou et al.

(10) Patent No.: US 10,290,924 B2
(45) Date of Patent: May 14, 2019

(54) ANTENNA STRUCTURE AND WIRELESS COMMUNICATION DEVICE USING SAME

(71) Applicant: Chiun Mai Communication Systems, Inc., New Taipei (TW)

(72) Inventors: Ming-Yu Chou, New Taipei (TW); Yu-Kai Tseng, New Taipei (TW); Kuo-Lun Huang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 130 days.

(21) Appl. No.: 15/399,749

(22) Filed: Jan. 6, 2017

(65) Prior Publication Data

US 2017/0244154 A1 Aug. 24, 2017

(30) Foreign Application Priority Data

Feb. 19, 2016 (CN) ..... 2016 1 0093269
May 19, 2016 (CN) ..... 2016 1 0339153

(51) Int. Cl.

| | |
|---|---|
| ***H01Q 1/22*** | (2006.01) |
| ***H01Q 1/24*** | (2006.01) |
| ***H01Q 13/10*** | (2006.01) |
| ***H01Q 1/48*** | (2006.01) |
| ***H01Q 1/36*** | (2006.01) |
| ***H01Q 9/42*** | (2006.01) |
| ***H01Q 19/26*** | (2006.01) |

(52) U.S. Cl.

CPC ..... *H01Q 1/243* (2013.01); *H01Q 1/36* (2013.01); *H01Q 1/48* (2013.01); *H01Q 9/42* (2013.01); *H01Q 13/106* (2013.01); *H01Q 19/26* (2013.01)

(58) Field of Classification Search

CPC ..... H01Q 1/243; H01Q 1/36; H01Q 1/48; H01Q 9/42; H01Q 13/106; H01Q 19/26

See application file for complete search history.

(56) References Cited

U.S. PATENT DOCUMENTS

| | | | | |
|---|---|---|---|---|
| 9,337,528 | B2 * | 5/2016 | Hammond | H01Q 1/243 |
| 2013/0285870 | A1 * | 10/2013 | Hotta | H01Q 1/243 343/843 |
| 2017/0040668 | A1 * | 2/2017 | Ayala Vazquez | H01Q 9/42 |
| 2017/0117620 | A1 * | 4/2017 | Lapushin | H01Q 1/38 |
| 2017/0194709 | A1 * | 7/2017 | Jansson | H01Q 7/00 |

FOREIGN PATENT DOCUMENTS

| | | |
|---|---|---|
| TW | 1274439 | 2/2007 |
| TW | M463914 U | 10/2013 |

* cited by examiner

*Primary Examiner* — Dameon E Levi
*Assistant Examiner* — David E Lotter
(74) *Attorney, Agent, or Firm* — ScienBiziP, P.C.

(57) ABSTRACT

An antenna structure includes a metallic frame and a stub antenna. The metallic frame defines a slot and two gaps. The two gaps are positioned at two ends of the slot and are substantially perpendicular to the slot. The metallic frame is divided into a first portion and a second portion by the slot and the two gaps. A portion of the metallic frame surrounded by the slot and the two gaps forms the first portion. The first portion serves as a radiator of the antenna structure and is grounded through the second portion. The stub antenna is positioned at an interior of the metallic frame and is spaced from the radiator.

19 Claims, 9 Drawing Sheets

ANTENNA STRUCTURE AND WIRELESS COMMUNICATION DEVICE USING SAME

CROSS-REFERENCE TO RELATED APPLICATIONS

This application claims priority to Chinese Patent Application No. 201610093269.8 filed on Feb. 19, 2016, and claims priority to Chinese Patent Application No. 201610339153.8 filed on May 19, 2016, the contents of which are incorporated by reference herein.

FIELD

The subject matter herein generally relates to an antenna structure and a wireless communication device using the antenna structure.

BACKGROUND

A typical global positioning system (GPS) antenna is generally positioned on a top of a wireless communication device, such as a mobile phone or a personal digital assistant (PDA). However, a radiating power of the GPS antenna will mainly focus on an upper-hemisphere radiating pattern, which will affect a receiving performance of the GPS antenna.

BRIEF DESCRIPTION OF THE DRAWINGS

Implementations of the present technology will now be described, by way of example only, with reference to the attached figures.

DETAILED DESCRIPTION

Figure 1:
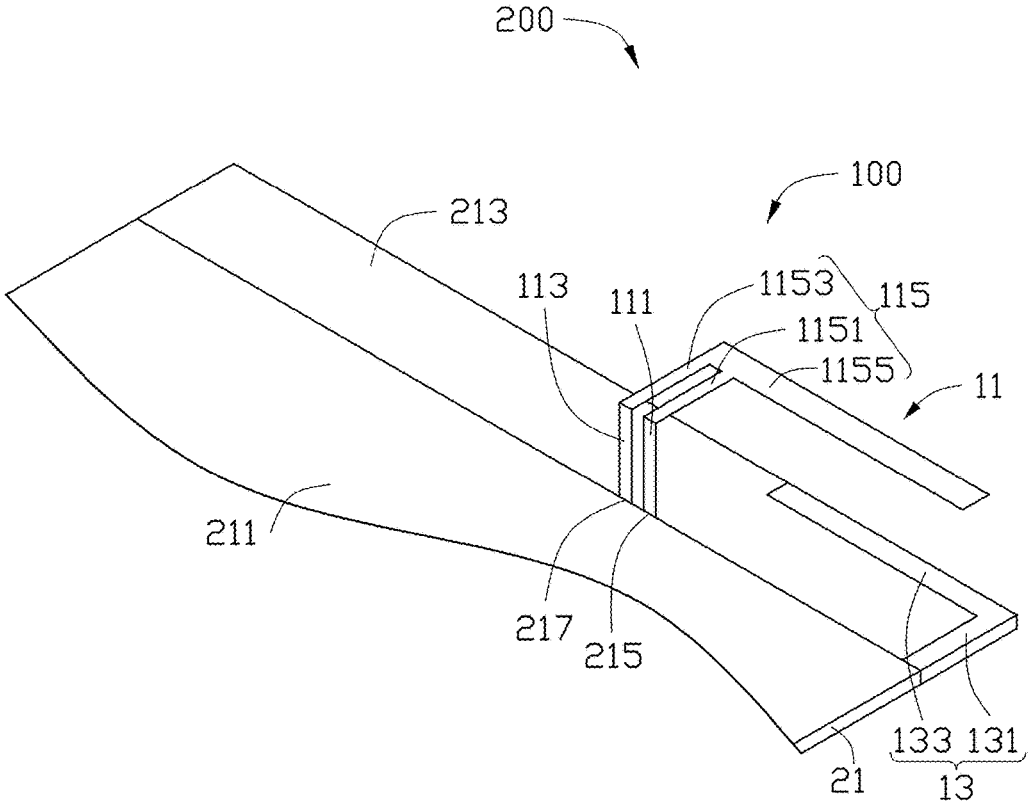
FIG. 1 is an isometric view of a first exemplary embodiment of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

FIG. 1 illustrates an embodiment of a wireless communication device 200 using a first exemplary antenna structure 100. The wireless communication device 200 can be a mobile phone or a personal digital assistant, for example. The antenna structure 100 is configured to receive/send wireless signals.

The wireless communication device 200 further includes a baseboard 21. The baseboard 21 is a printed circuit board (PCB) and can be made of a dielectric material, such as glass epoxy phenolic fiber (FR4). The baseboard 21 includes a ground plane 211 and a keep-out-zone 213. The keep-out-zone 213 is positioned adjacent to the ground plane 211. The baseboard 21 further includes a first feed point 215 and a ground point 217. The first feed point 215 is positioned on a side of the ground plane 211 adjacent to the keep-out-zone 213. The first feed point 215 is configured to feed current to the antenna structure 100. The ground point 217 is positioned on a side of the ground plane 211 adjacent to the keep-out-zone 213. The ground point 217 is spaced apart from the first feed point 225. The ground point 217 is electrically connected to the ground plane 211 and is configured to ground the antenna structure 100.

The antenna structure 100 includes a radiator 11 and a stub antenna 13. The radiator 11 and the stub antenna 13 are both positioned in an interior of the wireless communication device 200. In this exemplary embodiment, the radiator 11 is a global positioning system (GPS) antenna. The radiator 11 includes a feed portion 111, a ground portion 113, and a radiating portion 115. In this exemplary embodiment, the feed portion 111 is substantially a strip. The feed portion 111 is positioned in a plane substantially perpendicular to another plane where the baseboard 21 is positioned. The feed portion 111 is electrically connected to the first feed point 215 and is configured to feed current to the radiator 11. The ground portion 113 is substantially a strip. The ground portion 113 is coplanar with the feed portion 111. One end of the ground portion 113 is electrically connected to the ground point 217 and is configured to ground the radiating portion 115. Another end of the ground portion 113 extends along a direction parallel to the feed portion 111 to be parallel with the feed portion 111.

The radiating portion 115 is positioned in a plane substantially parallel to another plane where the baseboard 21 is positioned. The radiating portion 115 is positioned above the keep-out-zone 213. The radiating portion 115 is substantially F-shaped and includes a first radiating section 1151, a second radiating section 1153, and a third radiating section 1155. The first radiating section 1151 is substantially rectangular. The first radiating section 1151 is electrically connected to one end of the feed portion 111 away from the first feed point 215 and extends along a direction perpendicular to and away from the feed portion 111. The second radiating section 1153 is substantially rectangular. The second radiating section 1153 is positioned coplanar with the first radiating section 1151. The second radiating section 1153 is electrically connected to one end of the ground portion 113 away from the ground point 217 and extends along a direction parallel to the first radiating section 1151 and away from the ground portion 113. The second radiating section 1153 is parallel to the first radiating section 1151.

The third radiating section 1155 is substantially rectangular. The third radiating section 1155 is positioned perpendicular to the first radiating section 1151 and the second radiating section 1153. One end of the third radiating section 1155 is perpendicularly connected to one end of the second radiating section 1153 away from the ground portion 113. Another end of the third radiating section 1155 extends along a direction perpendicular to and towards the first radiating section 1151 until the third radiating section 1155 is perpendicularly connected to one end of the first radiating section 1151 away from the feed portion 111. Then, the third radiating section 1155 passes over the first radiating section 1151 and continually extends a direction perpendicular to and away from the first radiating section 1151. The first radiating section 1151, the second radiating section 1153, and the third radiating section 1155 cooperatively form the F-shaped structure.

In other exemplary embodiments, the radiator 11 is not limited to be F-shaped structure. The radiator 11 can be other structures, for example, the radiator 11 can be a monopole antenna, and it only needs to ensure that the radiator 11 can receive GPS signals.

In this exemplary embodiment, the stub antenna 13 is substantially L-shaped. The stub antenna 13 is positioned at the keep-out-zone 213. The stub antenna 13 includes a first stub section 131 and a second stub section 133. The first stub section 131 is substantially rectangular and is electrically connected to the ground plane 211. The second stub section 133 is substantially rectangular. One end of the second stub section 133 is perpendicularly connected to one end of the first stub section 131 away from the ground plane 211. Another end of the second stub section 133 extends along a direction perpendicular to the first stub section 131 and towards the first radiating section 1151 and the second radiating section 1153 until the second stub section 133 is overlapped with a projection of the third radiating section 1155 in the keep-out-zone 213. In this exemplary embodiment, a length of the second stub section 133 is about 19.6 mm. A distance between the second stub section 133 and the third radiating section 1155 is about 2.8 mm.

In other exemplary embodiments, the stub antenna 13 is not limited to be L-shaped and can be other shapes, for example, T-shaped. It only needs to ensure that the stub antenna 13 has one end grounded and another end floating, and the floating end of the stub antenna 13 is overlapped with a projection of the third radiating section 1155 in the keep-out-zone 213.

Figure 2:
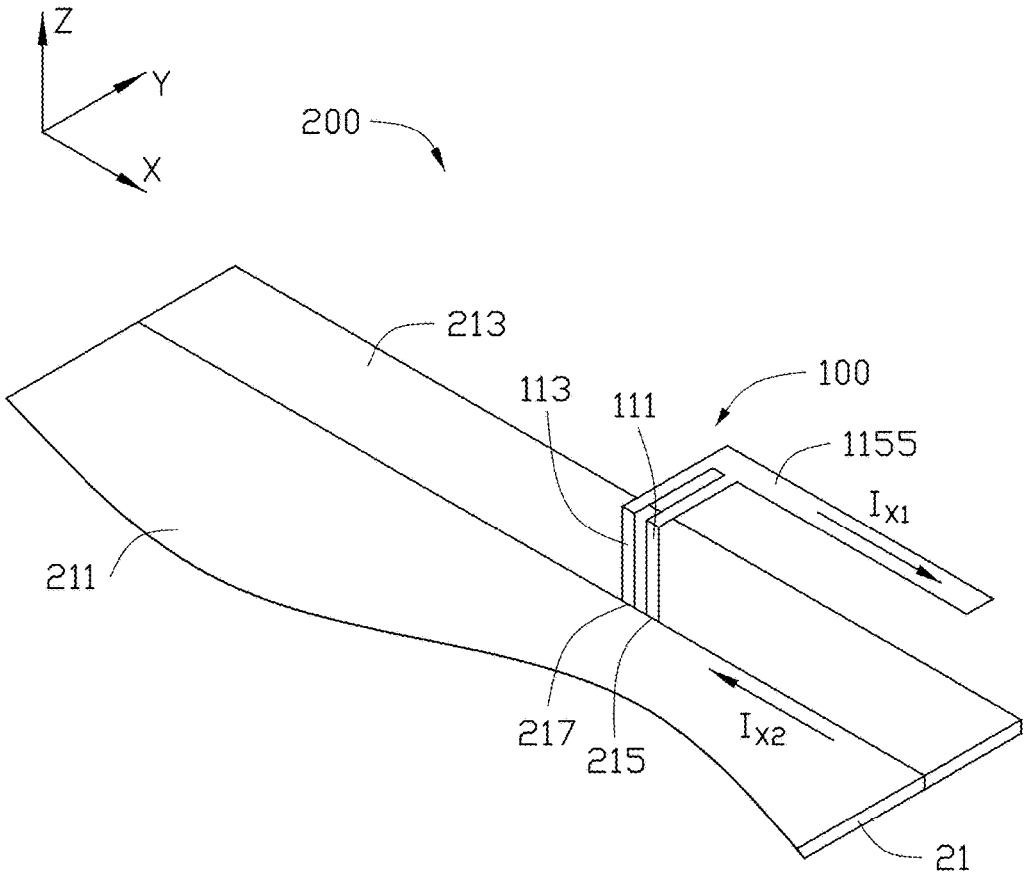
FIG. 2 is a current path distribution graph when the antenna structure of FIG. 1 does not include a stub antenna.

As illustrated in FIG. 2, when current is input to the feed portion 111 from the first feed point 215, the current flows to the third radiating section 1155 to form an X-direction current $I_{x1}$, and a current $I_{x2}$ flowing to the ground portion 113 will offset with the current $I_{x1}$. Then the current mainly flows to an Y-direction to form a polarization in the Y-direction, and the polarization in the Y-direction will make the most of radiating power of the antenna structure 100 to focus on a lower-hemisphere radiation pattern.

Figure 3:
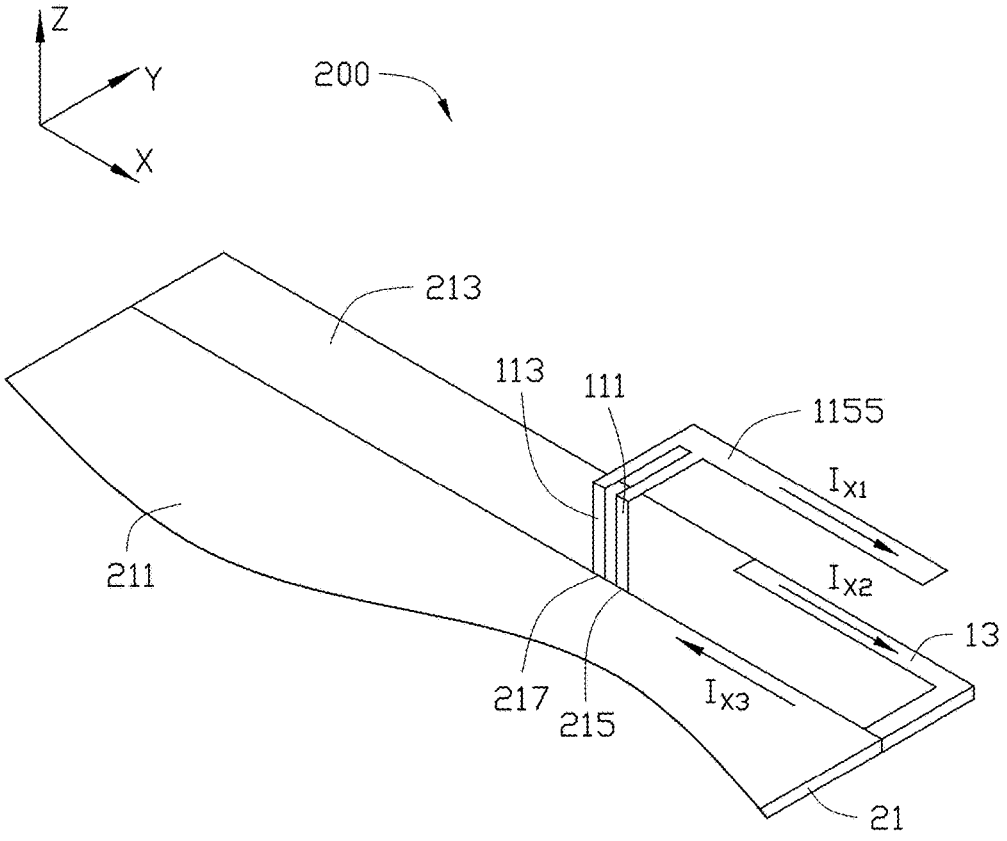
FIG. 3 is a current path distribution graph when the antenna structure of FIG. 1 includes a stub antenna.

As illustrated in FIG. 3, when current is input to the feed portion 111 from the first feed point 215, the current flows to the third radiating section 1155 to form an X-direction current $I_{x1}$. Due to the antenna structure 100 includes the L-shaped stub antenna 13, a current $I_{x2}$ flowing to the ground portion 113 will offset with a current $I_{x3}$. Then the X-direction current $I_{x1}$ forms a polarization in the X-direction. The polarization in the X-direction will make the most of radiating power of the antenna structure 100 to focus on an upper-hemisphere radiation pattern, and a performance of the antenna structure 100 for receiving GPS signals is improved.

Figure 4:
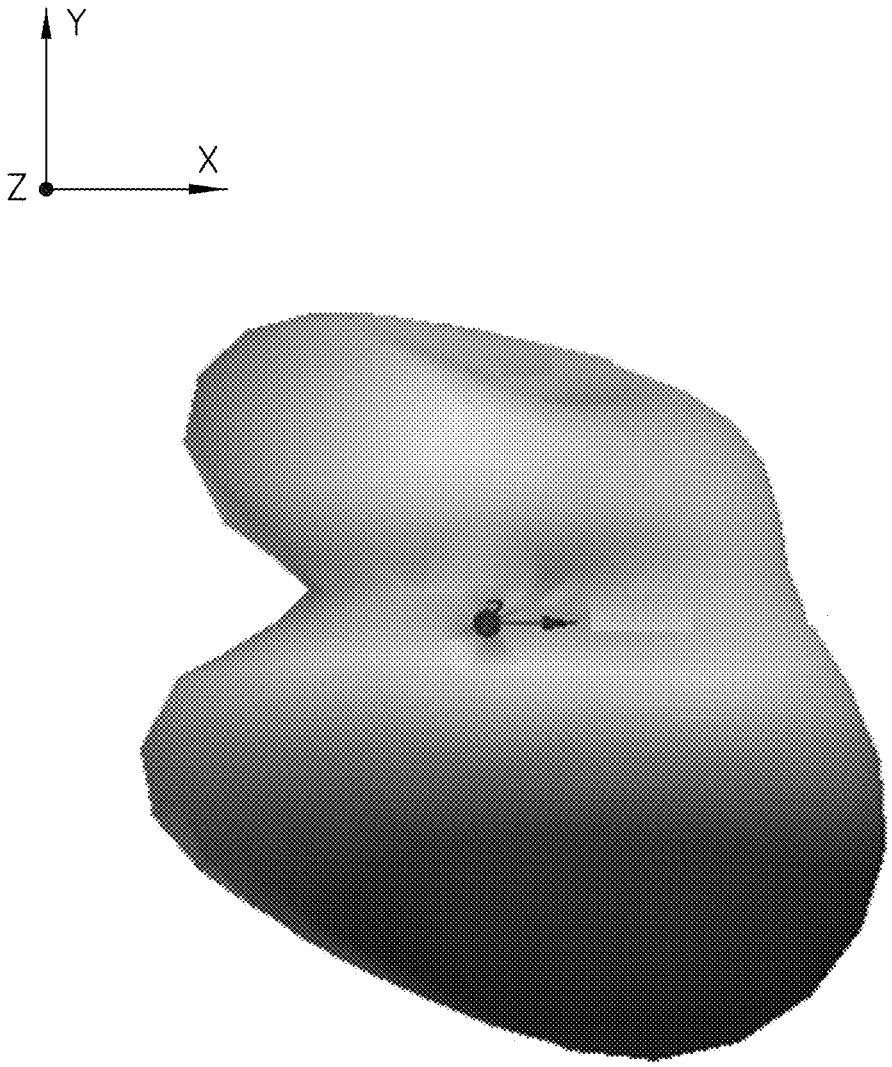
FIG. 4 is a radiation pattern graph when the antenna structure of FIG. 1 does not include a stub antenna.
Figure 5:
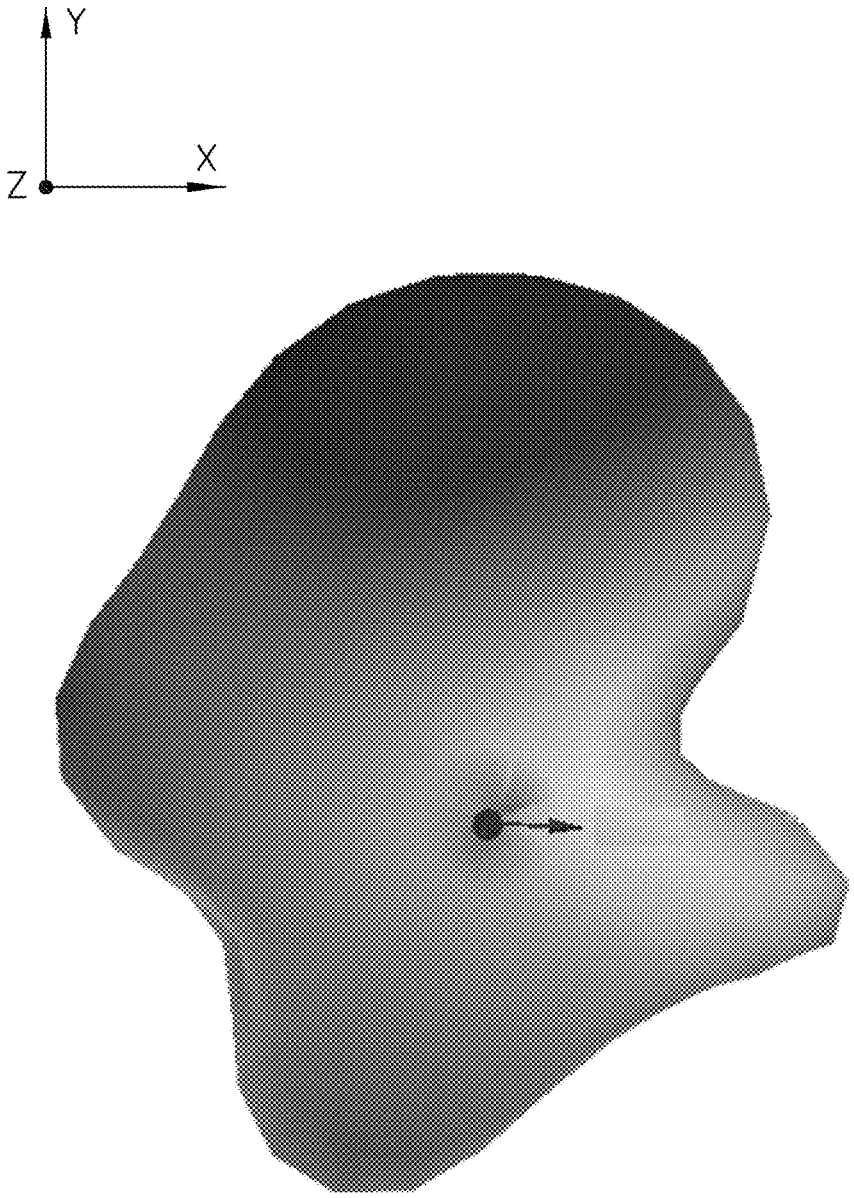
FIG. 5 is a radiation pattern graph when the antenna structure of FIG. 1 includes a stub antenna.

FIG. 4 illustrates a radiation pattern when the antenna structure 100 does not include the stub antenna 13. That is, when the antenna structure 100 does not include the stub antenna 13, a radiating power of the antenna structure 100 mainly focus on the lower-hemisphere of the radiating pattern. FIG. 5 illustrates a radiation pattern when the antenna structure 100 includes the stub antenna 13. That is, when the antenna structure 100 includes the stub antenna 13, a radiating power of the antenna structure 100 mainly focus on the upper-hemisphere of the radiating pattern, thereby improving a performance of the antenna structure 100 for receiving the GPS signals. In this exemplary embodiment, the lower-hemisphere and the upper-hemisphere cooperatively form the radiation pattern of the antenna structure 100.

It this exemplary embodiment, the X-direction in FIG. 2 is the same as the X-direction in FIGS. 3-5, the Y-direction in FIG. 2 is the same as the Y-direction in FIGS. 3-5, and the Z-direction in FIG. 2 is the same as the Z-direction in FIGS. 3-5. A upper direction of the wireless communication device 200 means a direction where a coordinate of Y-axis is increased. A lower direction of the wireless communication device 200 means a direction where a coordinate of the Y-axis is decreased. The third radiating section 1155 and the second stub section 133 are both positioned parallel to the X-axis. The first radiating section 1151, the second radiating section 1153, and the first stub section 131 are all positioned parallel to the Y-axis. The feed portion 111 and the ground portion 113 are both positioned parallel to the Z-axis.

In other exemplary embodiments, a measurement result shows that when the antenna structure 100 does not include the stub antenna 13, a partial radiated power (PRP) of the upper-hemisphere is about −7.21 dBm. When the antenna structure 100 includes the stub antenna 13, the PRP of the upper-hemisphere is about −3.09 dBm, which evidently improves a radiating power of the upper-hemisphere.

Figure 6:
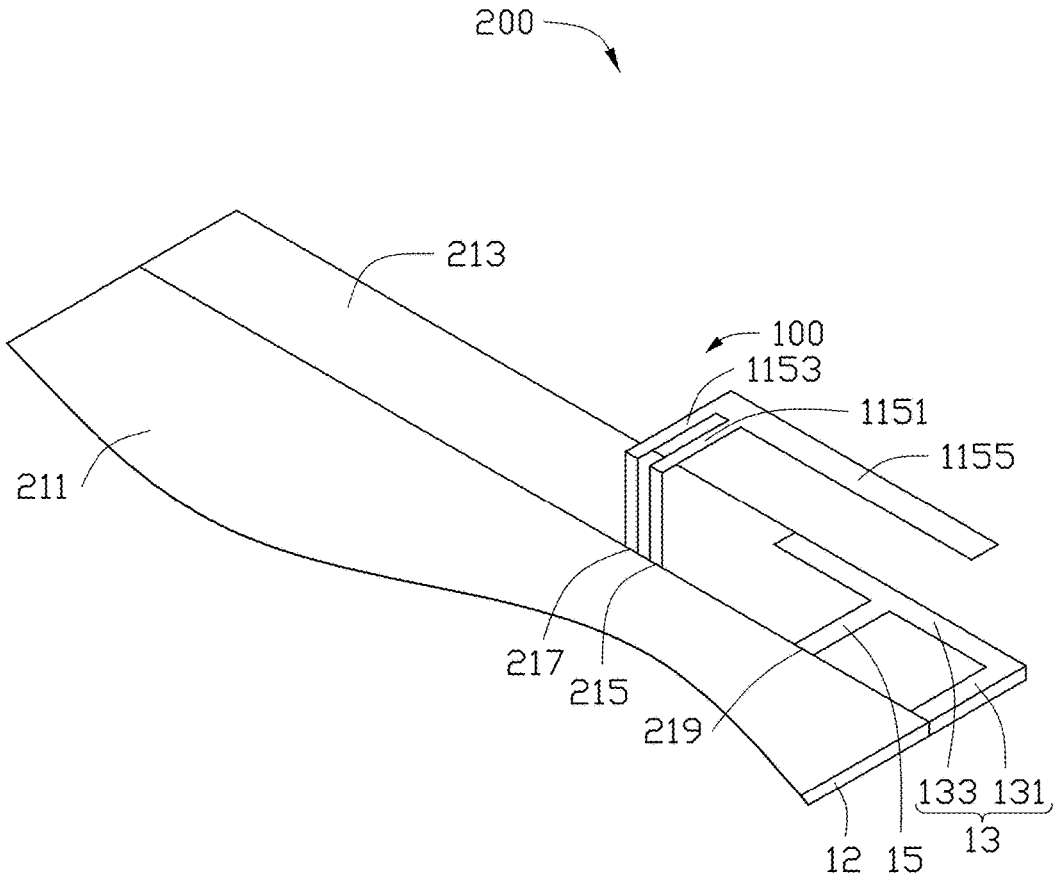
FIG. 6 is similar to FIG. 1, but showing the antenna structure further includes an extending portion.

As illustrated in FIG. 6, in other exemplary embodiments, the antenna structure 100 further includes an extending portion 15 and the wireless communication device 200 further includes a second feed point 219. The second feed point 219 is positioned at one side of the ground plane 211 close to the keep-out-zone 213. In this exemplary embodiment, the extending portion 15 is substantially rectangular and is coplanar with the stub antenna 13. One end of the extending portion 15 is electrically connected to the second feed point 219 and another end of the extending portion 15 is perpendicularly connected to the second stub section 133. The extending portion 15 is positioned parallel to the first stub section 131. The extending portion 15 and the first stub section 131 are positioned at a same side of the second stub section 133. The extending portion 15, the first stub section 131, and the second stub section 133 cooperatively form an F-shaped structure. The extending portion 15 is configured to feed current to the stub antenna 13. Then the stub antenna 13 can work at a 2.4 GHz band and 5 GHz band to form a GPS/WIFI dual-band design.

Figure 7:
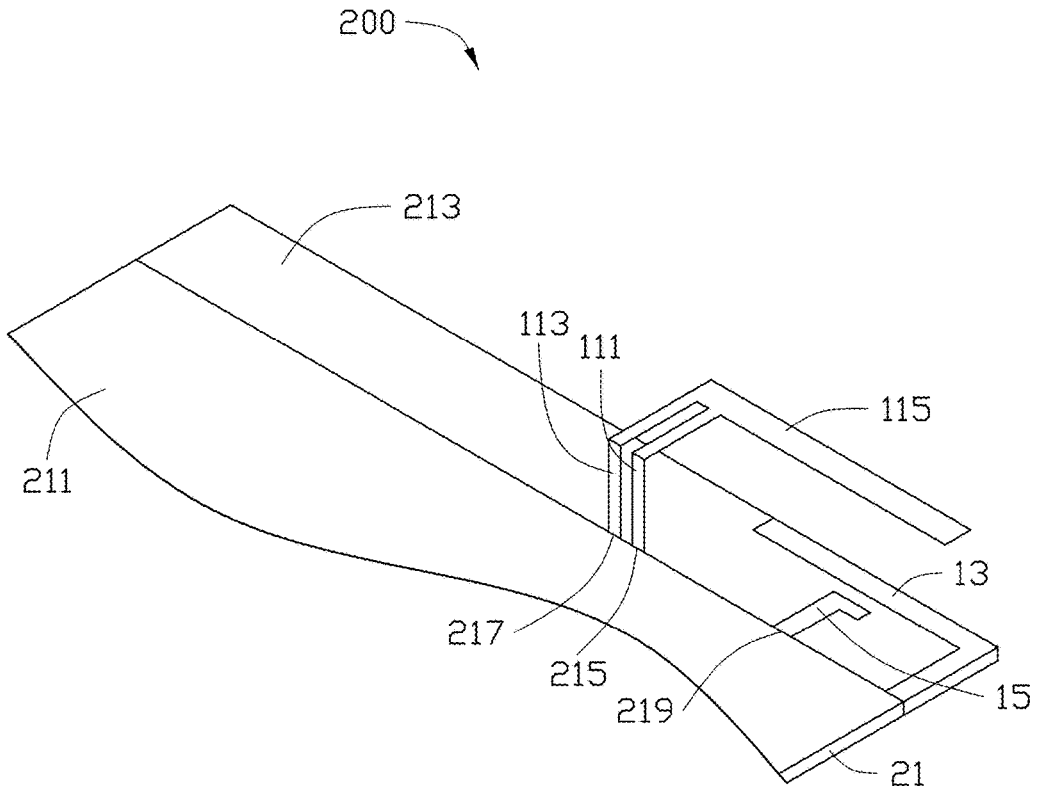
FIG. 7 is similar to FIG. 1, but showing the antenna structure further includes another extending portion.

In other exemplary embodiments, the extending portion 15 is not limited to be rectangular and can be other shapes, for example, L-shaped or T-shaped. As illustrated in FIG. 7, the extending portion 15 is L-shaped. The extending portion 15 is also not limited to be electrically connected to the stub antenna 13. The extending portion 15 can be spaced apart from the stub antenna 13. Then the current from the extending portion 15 can be coupled to the stub antenna 13 and the stub antenna 13 can work at the WIFI band.

In other exemplary embodiments, the antenna structure 100 can further include a holder (not shown). The holder can be made of insulating material and is positioned on the keep-out-zone 213. The stub antenna 13 is not limited to be directly positioned on the keep-out-zone 213. The stub antenna 13 can be positioned on the holder and the second stub section 133 of the stub antenna 13 is spaced apart from the third radiating section 1155. It can be understood that the holder can also be configured to support the radiator 11 and it only needs to ensure that the stub antenna 13 is spaced apart from the third radiating section 1155.

Figure 8:
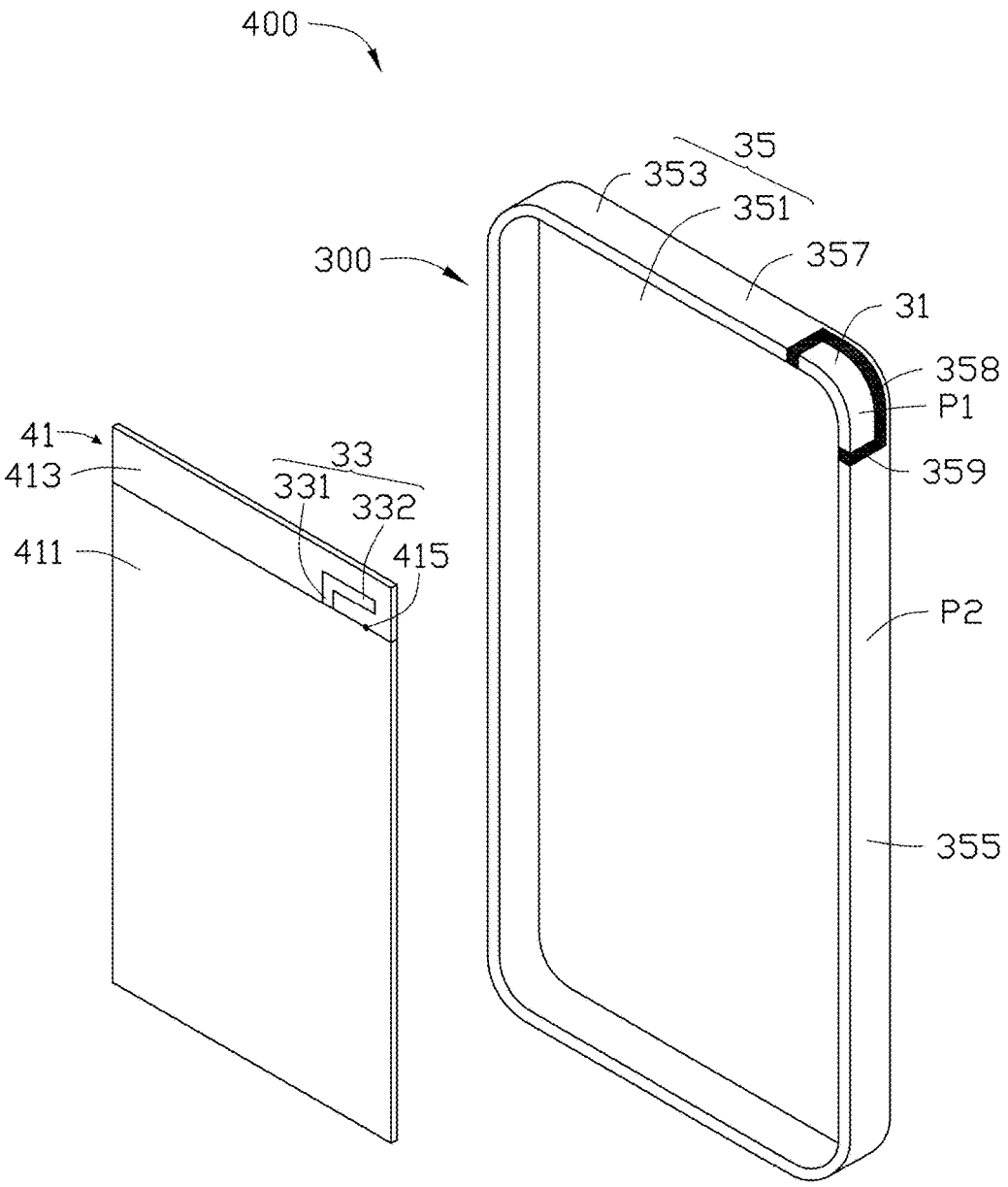
FIG. 8 is an isometric view of a second exemplary embodiment of a wireless communication device using a second exemplary antenna structure.

FIG. 8 illustrates an exemplary embodiment of a wireless communication device 400 using a second exemplary antenna structure 300. The antenna structure 300 is configured to receive/send wireless signals.

The antenna structure 300 includes a radiator 31 and a stub antenna 33. The radiator 31 is spaced apart from the stub antenna 33. The stub antenna 33 is positioned on a baseboard 41 of the wireless communication device 400. The baseboard 41 is a printed circuit board (PCB) and can be made of a dielectric material, such as glass epoxy phenolic fiber (FR4). The baseboard 41 includes a ground plane 411 and a keep-out-zone 413. In this exemplary embodiment, the stub antenna 33 is substantially L-shaped and is positioned at the keep-out-zone 413. The stub antenna 33 includes a first stub section 331 and a second stub section 332. The first stub section 331 is substantially rectangular and is electrically connected to the ground plane 411. The second stub section 333 is substantially rectangular. The second stub section 332 is perpendicularly connected to one end of the first stub section 331 away from the ground plane 411.

In other exemplary embodiments, the stub antenna 33 is not limited to be L-shaped and can be other shapes, for example, T-shaped. It only needs to ensure that the stub antenna 33 has one end grounded and another end floating.

In this exemplary embodiment, the antenna structure 300 further includes a metallic member 35. The metallic member 35 can be a decorative member, for example, an external metallic frame of the wireless communication device 400. In this exemplary embodiment, the metallic member 35 is a frame structure and includes a metallic backboard 351 and a metallic frame 353. The metallic frame 353 is perpendicularly positioned at a periphery of the metallic backboard 351. The metallic frame 353 includes two parallel first arm 355 and two parallel second arm 357.

The metallic frame 353 defines a slot 358. In this exemplary embodiment, the slot 358 is defined at one of the two second arms 357 and extends to one of the two first arms 355. The metallic frame 353 further defines two gaps 359. In this exemplary embodiment, the two gaps 359 are positioned at two ends of the slot 358 and are substantially perpendicular to the slot 358. The slot 358 and the two gaps 359 cooperatively divide the metallic frame 353 into two portions, that is, a first portion P1 and a second portion P2. In detail, a portion of the metallic frame 353 surrounded by the slot 358 and the gaps 359 forms the first portion P1 and the first portion P1 is served as the radiator 31. The second portion P2 is electrically connected to the metallic backboard 351 and is grounded.

In other exemplary embodiments, the slot 358 and the two gaps 359 can be filled with insulating material, for example, a plastic or a rubber, thereby isolating the first portion P1 and the second P1. The insulating material is also configured to isolate the first portion P1 and the metallic backboard 351.

In this exemplary embodiment, the radiator 31 is a GPS antenna. A total length of the radiator 31 is less than or equal to a quarter of wavelength ($\lambda/4$) of a GPS signal received by the radiator 31. One end of the radiator 31 is electrically connected to the first feed point 415 of the baseboard 41 to feed current to the radiator 31. The radiator 31 is further electrically connected to the second portion P2 through a connecting structure, for example, a connecting line, a piece of flexible conductor or the like, that is, the radiator 31 is grounded through the second portion P2 of the metallic frame 353.

In this exemplary embodiment, the radiator 31 is positioned at a top right corner of the wireless communication device 400 and is substantially L-shaped. In other exemplary embodiments, the radiator 31 can also be positioned at other positions of the metallic frame 353, for example, the radiator 31 can be positioned at a top left corner of the wireless communication device 400 or a top of the wireless communication device 400. When the radiator 31 is positioned at the top of the wireless communication device 400, that is, the radiator 31 is positioned at the top second arm 357, the radiator 31 is substantially rectangular and the slot 358 and the two gaps 359 are all defined at the top second arm 357.

In this exemplary embodiment, the slot 358 is defined at an end of the metallic frame 353 adjacent to the metallic backboard 351. In other exemplary embodiments, a position of the slot 358 in the metallic frame 353 can be adjusted. For example, the slot 358 can be positioned at an end of the metallic frame 353 away from the metallic backboard 351, thereby a width of the radiator 31 can be effectively adjusted.

It is similar to the antenna structure 100, when the antenna structure 300 includes the stub antenna 33, a direction of the ground-current of the antenna structure 300 can be changed, and a polarization direction of the antenna structure 300 is changed. Then an upper-hemisphere radiation pattern of the antenna structure 300 and a performance of the antenna structure 300 for receiving GPS signals can be effectively improved. Additionally, the radiator 31 is directly formed by the first portion P1 of the metallic frame 353 of the metallic member 35, which can decrease a volume of the wireless communication device 400. The slot 358 and the gaps 359 are all defined on the metallic frame 353 instead of the metallic backboard 351. Therefore, the metallic backboard 351 forms an all-metal structure, that is, the slot 358 and the gaps 359 do not take up space of the metallic backboard 351.

Figure 9:
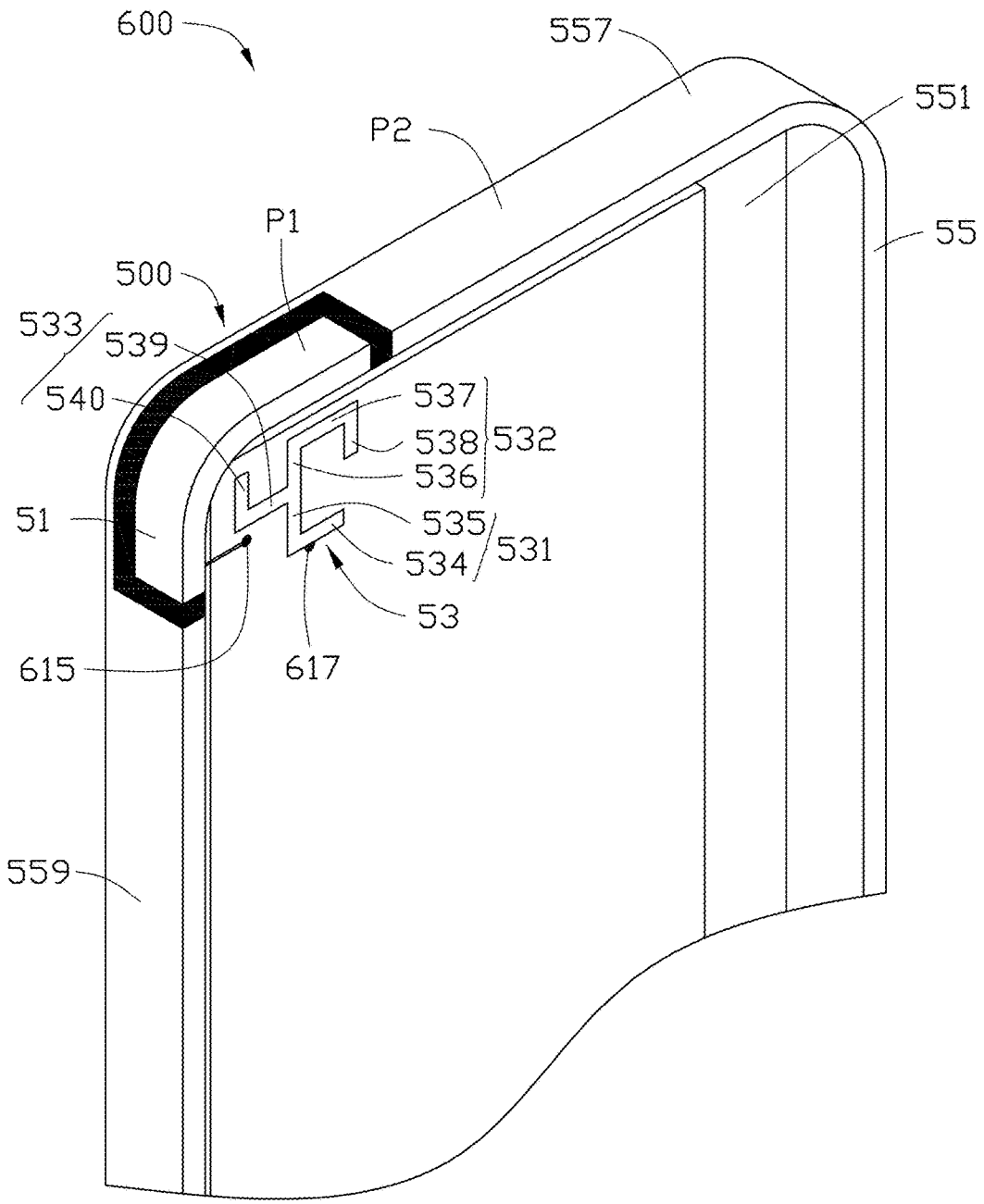
FIG. 9 is an isometric view of a third exemplary embodiment of a wireless communication device using a third exemplary antenna structure.

FIG. 9 illustrates an exemplary embodiment of a wireless communication device 600 using a third exemplary antenna structure 500. The antenna structure 500 is configured to receive/send wireless signals.

The antenna structure 500 includes a radiator 51, a stub antenna 53, and a metallic member 55. The radiator 51 is spaced apart from the stub antenna 53. The radiator 51 is formed by a first portion P1 of the metallic member 55 of the antenna structure 500. The radiator 51 is electrically connected to the first feed point 615 of the wireless communication device 600 and is configured to feed current to the radiator 51.

The antenna structure 500 differs from the antenna structure 300 in that the radiator 51 is positioned at a top left corner of the wireless communication device 600. It can be understood that the radiator 51 can also be positioned at other positions of the wireless communication device 600. For example, the radiator 51 is positioned at a top right corner of the wireless communication device 600 or a top of the wireless communication device 600. When the radiator 51 is positioned at the top of the wireless communication device 600, that is, the radiator 51 is positioned at the top second arm 557, the radiator 51 is substantially rectangular.

The antenna structure 500 differs from the antenna structure 300 in that a structure of the stub antenna 53 is different from a structure of the stub antenna 33. In detail, the stub antenna 53 includes a connecting portion 531, a first branch 532, and a second branch 533. The connecting portion 531, the first branch 532, and the second branch 533 are coplanar. The connecting portion 531 is substantially L-shaped and includes a first connecting section 534 and a second connecting section 535. The first connecting section 534 is electrically connected to a second feed point 617 of the wireless communication device 600 and is parallel to the second arm 537. The first connecting section 534 is configured to feed current to the stub antenna 53. An end of the second connecting section 535 is perpendicularly connected to an end of the first connecting section 534. Another end of the second connecting section 535 extends along a direction parallel to the first arm 559 and towards the second arm 557, thereby forming the L-shaped structure with the first connecting section 534.

The first branch 532 includes a first extending section 536, a second extending section 537, and a third extending section 538. The first extending section 536 is substantially rectangular. One end of the first extending section 536 is electrically connected to one end of the second connecting section 535 away from the first connecting section 534. Another end of the first extending section 536 continually extends a direction perpendicular to and away from the first connecting section 534. The first extending section 536 is collinear with the second connecting section 535. The second extending section 537 is substantially rectangular. One end of the second extending section 537 is perpendicularly connected to an end of the first extending section 536 away from the second connecting section 535. Another end of the second extending section 537 extends along a direction parallel to the first connecting section 534 and away from the first extending section 536. That is, the second extending section 537 and the first connecting section 534 are positioned at a same side of the second connecting section 535 and the first extending section 536. The third extending section 538 is substantially rectangular. One end of the third extending section 538 is perpendicularly connected to an end of the second extending section 537 away from the first extending section 536. Another end of the third extending section 538 extends along a direction parallel to the second connecting section 535 and towards the first connecting section 534.

The second branch 533 is substantially L-shaped and includes a first resonating section 539 and a second resonating section 540. One end of the first resonating section 539 is perpendicularly connected to a junction of the second connecting section 535 and the first extending section 536. Another end of the first resonating section 539 extends along a direction parallel to the first connecting section 534 and towards the radiator 51. The second resonating section 540 is substantially rectangular. One end of the second resonating section 540 is perpendicularly connected to an end of the first resonating section 539 away from the second connecting section 535 and the first extending section 536. Another end of the second resonating section 540 extends along a direction perpendicular to the first resonating section 539 and towards the second extending section 537, thereby forming the L-shaped structure with the first resonating section 539.

In this exemplary embodiment, the current from the first feed point 615 flows to the radiator 51 and the current from the second feed point 617 flows to the stub antenna 53. In detail, one portion of the current from the second feed point 617 flows to the connecting portion 531 and the first branch 532, and the stub antenna 53 works at 2.4 GHz band. Another portion of the current from the second feed point 617 flows to the connecting portion 531 and the second branch 533, and the stub antenna 53 works at 5 GHz band. Additionally, the current from the first feed point 615 flows to the radiator 51 and the radiator 51 can receive the GPS signals.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a metallic frame, the metallic frame defining a slot and two gaps, wherein the two gaps are positioned at two ends of the slot and are substantially perpendicular to the slot, the metallic frame is divided into a first portion and a second portion by the slot and the two gaps, a portion of the metallic frame surrounded by the slot and the two gaps forms the first portion, the first portion serves as a radiator of the antenna structure and is grounded through the second portion; and a stub antenna, the stub antenna positioned at an interior of the metallic frame and spaced from the radiator.

2. The antenna structure of claim 1, wherein the metallic frame is a metallic frame of a wireless communication device and is positioned at a periphery of a metallic backboard of the wireless communication device.

3. The antenna structure of claim 1, wherein the radiator is a global positioning system (GPS) antenna, a total length of the radiator is less than or equal to a quarter of wavelength of a GPS signal received by the radiator.

4. The antenna structure of claim 1, wherein the slot and the two gaps are filled with insulating material.

5. The antenna structure of claim 1, wherein the stub antenna is substantially L-shaped.

6. The antenna structure of claim 1, wherein the radiator is electrically connected to the second portion through a connecting structure and the radiator is grounded through the second portion.

7. The antenna structure of claim 1, wherein the stub antenna comprises a connecting portion and a first branch, the connecting portion is substantially L-shaped and comprises a first connecting section and a second connecting section, the first connecting section is configured to feed current to the stub antenna, the second connecting section is perpendicularly connected to an end of the first connecting section; the first branch comprises a first extending section, a second extending section, and a third extending section, one end of the first extending section is connected to one end of the second connecting section away from the first connecting section and is collinear with the second connecting section, one end of the second extending section is perpendicularly connected to an end of the first extending section away from the second connecting section, another end of the second extending section extends along a direction parallel to the first connecting section and away from the first extending section, one end of the third extending section is perpendicularly connected to an end of the second extending section away from the first extending section, another end of the third extending section extends along a direction parallel to the second connecting section and towards the first connecting section.

8. The antenna structure of claim 7, wherein the stub antenna further comprises a second branch, the second branch comprises a first resonating section and a second resonating section, one end of the first resonating section is perpendicularly connected to a junction of the second connecting section and the first extending section, another end of the first resonating section extends along a direction parallel to the first connecting section and towards the radiator, one end of the second resonating section is perpendicularly connected to an end of the first resonating section away from the second connecting section and the first extending section, another end of the second resonating section extends along a direction perpendicular to the first resonating section and towards the second extending section.

9. The antenna structure of claim 8, wherein the connecting portion, the first branch, and the second branch are coplanar.

10. A wireless communication device comprising:

a baseboard; and an antenna structure comprising:

a metallic frame, the metallic frame defining a slot and two gaps, wherein the two gaps are positioned at two ends of the slot and are substantially perpendicular to the slot, the metallic frame is divided into a first portion and a second portion by the slot and the two gaps, a portion of the metallic frame surrounded by the slot and the two gaps forms the first portion, the first portion serves as a radiator of the antenna structure and is grounded through the second portion; and a stub antenna, the stub antenna positioned on the baseboard and spaced from the radiator.

11. The wireless communication device of claim 10, wherein baseboard comprises a first feed point and a second feed point, the first feed point is electrically connected to the radiator to feed current to the radiator, and the second feed point is electrically connected to the stub antenna to feed current to the stub antenna.

12. The wireless communication device of claim 10, wherein the metallic frame is a metallic frame of a wireless communication device and is positioned at a periphery of a metallic backboard of the wireless communication device.

13. The wireless communication device of claim 10, wherein the radiator is a global positioning system (GPS) antenna, a total length of the radiator is less than or equal to a quarter of wavelength of a GPS signal received by the radiator.

14. The wireless communication device of claim 10, wherein the slot and the two gaps are filled with insulating material.

15. The wireless communication device of claim 10, wherein the stub antenna is substantially L-shaped.

16. The wireless communication device of claim 10, wherein the radiator is electrically connected to the second portion through a connecting structure and the radiator is grounded through the second portion.

17. The wireless communication device of claim 10, wherein the stub antenna comprises a connecting portion and a first branch, the connecting portion is substantially L-shaped and comprises a first connecting section and a second connecting section, the first connecting section is configured to feed current to the stub antenna, the second connecting section is perpendicularly connected to an end of the first connecting section; the first branch comprises a first extending section, a second extending section, and a third extending section, one end of the first extending section is connected to one end of the second connecting section away from the first connecting section and is collinear with the second connecting section, one end of the second extending section is perpendicularly connected to an end of the first extending section away from the second connecting section, another end of the second extending section extends along a direction parallel to the first connecting section and away from the first extending section, one end of the third extending section is perpendicularly connected to an end of the second extending section away from the first extending section, another end of the third extending section extends along a direction parallel to the second connecting section and towards the first connecting section.

18. The wireless communication device of claim 17, wherein the stub antenna further comprises a second branch, the second branch comprises a first resonating section and a second resonating section, one end of the first resonating section is perpendicularly connected to a junction of the second connecting section and the first extending section, another end of the first resonating section extends along a direction parallel to the first connecting section and towards the radiator, one end of the second resonating section is perpendicularly connected to an end of the first resonating section away from the second connecting section and the first extending section, another end of the second resonating section extends along a direction perpendicular to the first resonating section and towards the second extending section.

19. The wireless communication device of claim 18, wherein the connecting portion, the first branch, and the second branch are coplanar.

* * * * *